US011613947B2

(12) United States Patent
Gunsaulis

(10) Patent No.: US 11,613,947 B2
(45) Date of Patent: Mar. 28, 2023

(54) DRILL PIPE WITH INTERNAL FLOW CHECK VALVE

(71) Applicant: The Charles Machine Works, Inc., Perry, OK (US)

(72) Inventor: Floyd R. Gunsaulis, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 0 days.

(21) Appl. No.: 17/510,821

(22) Filed: Oct. 26, 2021

(65) Prior Publication Data

US 2022/0136347 A1 May 5, 2022

Related U.S. Application Data

(60) Provisional application No. 63/106,926, filed on Oct. 29, 2020.

(51) Int. Cl.
*E21B 21/10* (2006.01)
*E21B 17/18* (2006.01)

(52) U.S. Cl.
CPC ..... *E21B 21/106* (2013.01); *E21B 17/18* (2013.01)

(58) Field of Classification Search
CPC ..... E21B 21/10; E21B 21/00; E21B 17/18
See application file for complete search history.

(56) References Cited

U.S. PATENT DOCUMENTS

| | | | | |
|---|---|---|---|---|
| 1,790,480 | A * | 1/1931 | Macomber | E21B 21/10 137/429 |
| 2,153,812 | A * | 4/1939 | Newton | E21B 21/10 166/325 |
| 3,096,825 | A * | 7/1963 | Clark, Jr. | E21B 21/10 166/325 |
| 4,622,993 | A * | 11/1986 | Taylor | E21B 21/10 137/542 |
| 7,311,118 | B2 | 12/2007 | Doutt | |
| 8,955,605 | B2 | 2/2015 | VanLue | |
| 2018/0010424 | A1 * | 1/2018 | Hawkins, III | E21B 34/10 |

* cited by examiner

*Primary Examiner* — David Carroll
(74) *Attorney, Agent, or Firm* — Tomlinson McKinstry, P.C.

(57) ABSTRACT

A check valve assembly disposed within a pipe joint. The valve assembly is bounded by a pin end on one side and a liner tube on the other. In a first flow condition, a ball is forced away from the pin end and toward a stop member. The stop member has a geometry to allow fluid flow around the ball and through passageways within the stop when in the first flow condition. In a second flow condition, opposite the first flow condition, the ball is forced toward a tapered seat on the pin end, restricting fluid flow in the second flow condition.

14 Claims, 4 Drawing Sheets

DRILL PIPE WITH INTERNAL FLOW CHECK VALVE

SUMMARY

The present invention is directed to a drill pipe assembly. The drill pipe assembly comprises a hollow pipe, a pin end, and a ball valve. The hollow pipe has a first internal passageway. The pin end is adjoined to the hollow pipe and has a second internal passageway. The ball valve is disposed between the first internal passageway and the second internal passageway. The ball valve comprises a spacer and a ball. The spacer has fluid passageways disposed therethrough and an external diameter greater than an internal diameter of the first internal passageway. The ball is disposed between the second internal passageway and the spacer and is configured to obstruct flow directed from the first internal passageway to the second internal passageway. The spacer is configured to prevent the ball from obstructing flow directed from the second internal passageway to the first internal passageway.

DETAILED DESCRIPTION

Horizontal Directional Drilling (HDD) is used to install many underground utility lines. Most of the time, a water-based drilling fluid is used during the drilling process to clean the bit, cool the downhole electronics, help support the bore hole, and help move spoils out of the hole. Minimizing the amount of drilling fluid used is preferable to reduce overall cost of each installation. Reducing the amount of fluid that is released near the boring unit helps to provide for a cleaner, safer, and more aesthetically pleasing work site. The device of this disclosure helps to reduce overall drilling fluid usage and, in particular, reduces the amount of fluid released near the drilling unit.

Figure 1:
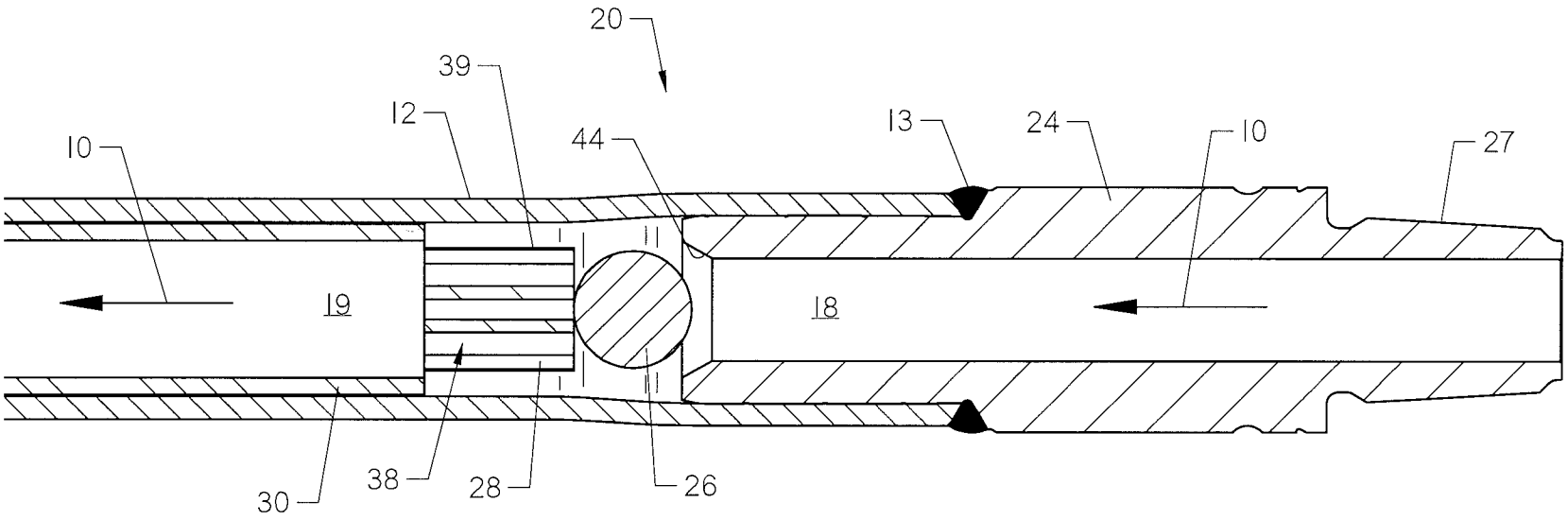
FIG. 1 is a cross-sectional view of a pipe joint taken along a plane that intersects a longitudinal axis of the pipe joint. A ball check valve is shown disposed within the pipe joint and is shown in an open position, with flow being allowed from the right to the left on the page.
Figure 2:
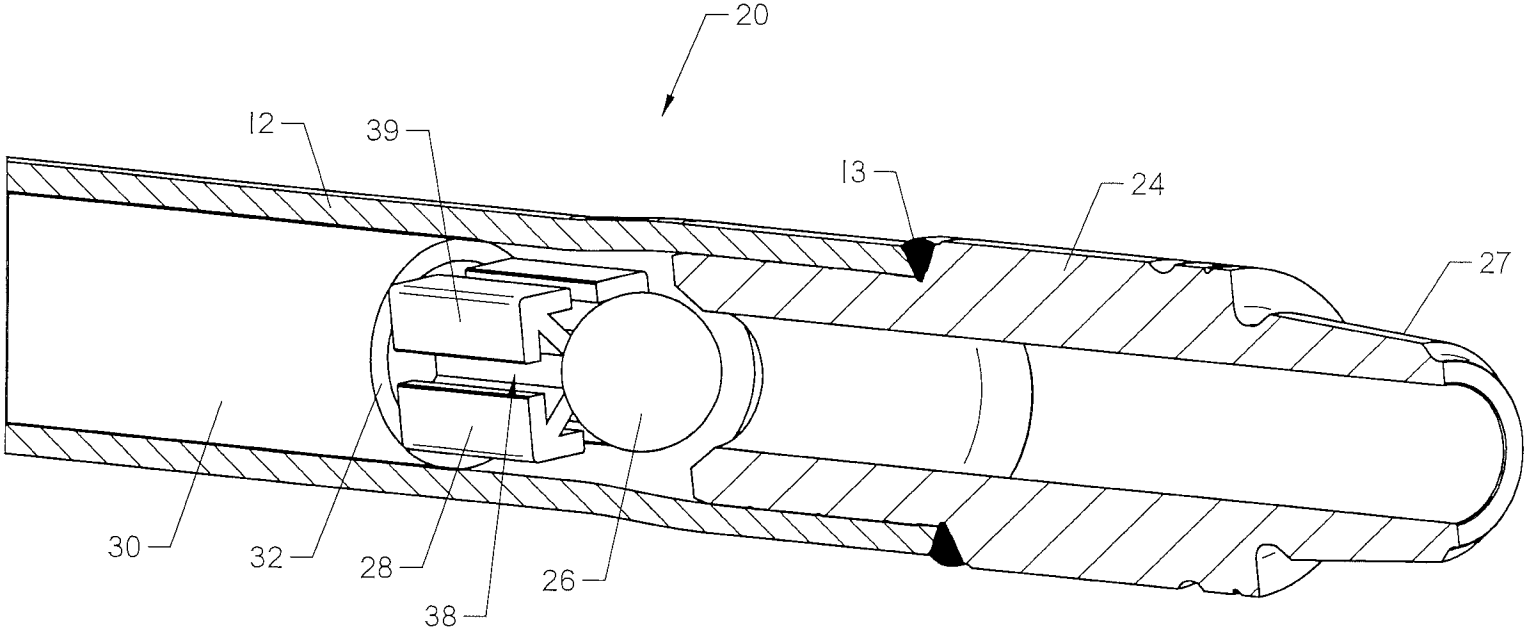
FIG. 2 is a perspective cross-sectional view of the pipe joint shown in FIG. 1, but the ball, stop member, and liner pipe of the check valve are not shown in cross-section.
Figure 3:
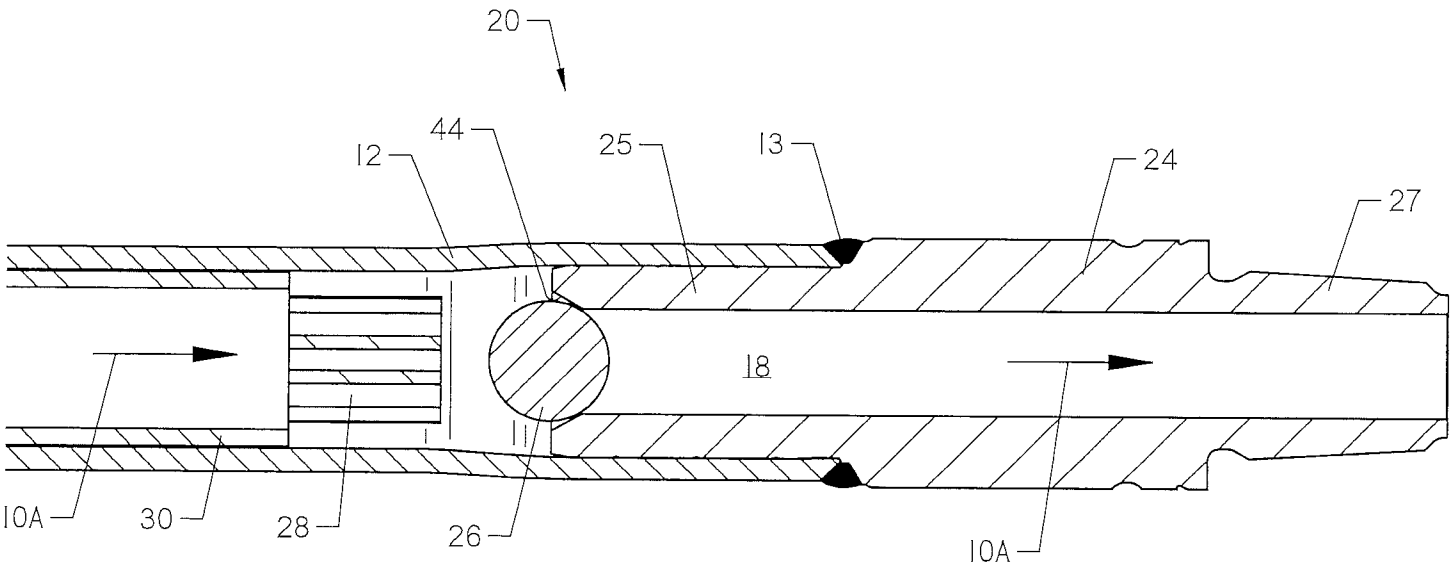
FIG. 3 is the cross-sectional view of the pipe joint shown in FIG. 1, but the ball check valve is shown in a closed position, with flow being cut off from the left to the right on the page.
Figure 4:
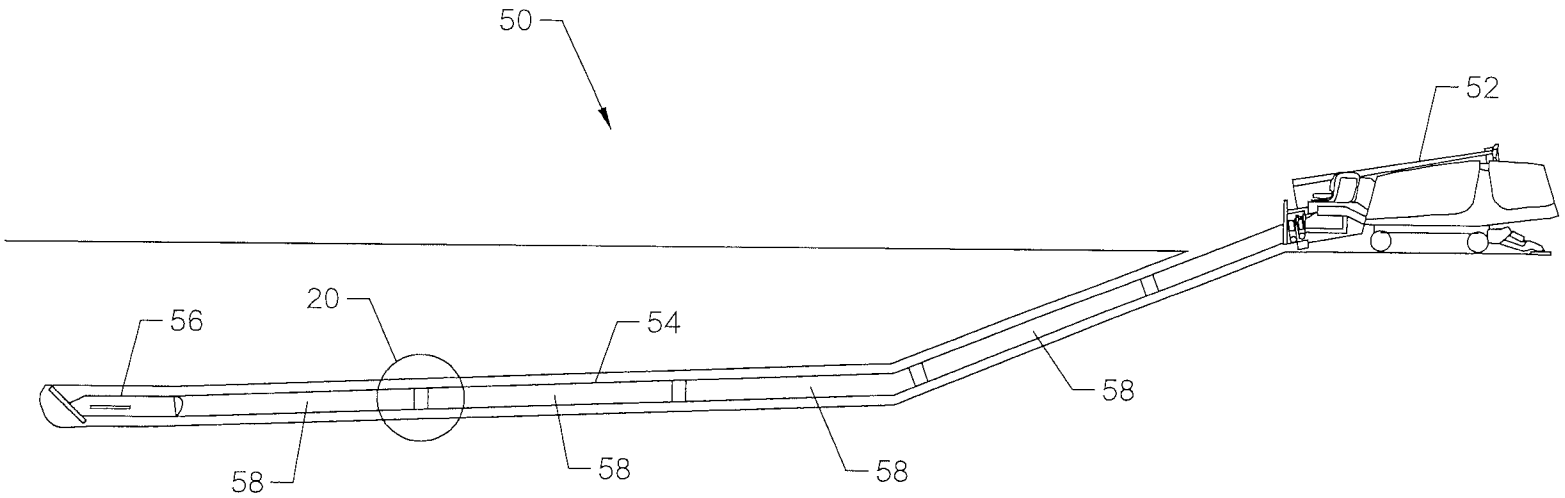
FIG. 4 is an illustration of a horizontal directional drilling operation.

FIG. 4 shows such an HDD system 50. The HDD system 50 comprises a drilling unit 52, a drill string 54, and a downhole tool 56. The downhole tool 56 may include a bit, for which drilling fluid is used. As shown, the drill string 54 is made up of a plurality of individual, similarly constructed segments 58. FIGS. 1-3 show the connection locations between these segments 58. At an uphole end, each pipe segment 58 has a pipe feature assembly 20, which is shown with more particularity in FIGS. 1-3.

In FIGS. 1-3, the pipe feature assembly 20 comprises a male tool joint connection, or pin 24. The pin 24 is placed inside an outer drill tube 12 and attached by a weld 13 or other connection. The pin 24 may have a threaded connection 27 which is adapted for connection to a box end of an adjoining segment 58 (not shown). The assembly 20 comprises a ball 26, a stop member or spacer 28, a liner tube 30, and the outer drill tube 12. When the drill string 54 is used in its normal configuration, the threaded connection 27 of the pin 24 faces toward the drilling unit 52.

Flow, shown by arrows 10, is pumped through the pipe feature assembly 20. As shown in FIG. 1, the ball 26 is forced away from the pin 24 and into contact with the stop member 28. The ball 26 is of larger diameter than the internal passageway 18 through the pin 24, but is appreciably smaller than the inner diameter of the outer drill tube 12 such that fluid may easily flow around it. The stop member 28 has a shape such that it contacts a leading shoulder 32 of liner tube 30 (as shown in FIG. 2) so that it may not move into the inner diameter of liner tube 30. The liner tube 30 has an internal passageway 19 which is therefore not obstructed by the ball 26 due to the intervening position of the stop member 28.

The stop member 28 further comprises openings, or passageways 38, in its geometry that allow drilling fluid to flow past it and into the interior of the lining tube 30. The stop member 28 may be made from an extruded material such as aluminum or plastic. Alternatively, it could be made from many durable materials such as steel, brass, bronze, or stainless steel. It may be cut from an extruded shape, or made by casting, or other forming methods such as drawing or bending.

As shown, the stop member 28 has a cross shape with externally-disposed rectilinear flanges 39 which interact with the leading shoulder 32 of the inner lining tube 10. Other geometries may be utilized, such as star shapes, hexes, and the like, which would serve to stop the ball 26 from checking flow in the preferred direction while allowing flow in and around the stop member 28 itself.

When a drill string 54 is disconnected from the drilling unit 52 to add or remove another pipe segment 58, the fluid inside the drill string will normally be under pressure. The pressure in the drill string 54 will cause a surge of fluid to attempt to flow in the direction opposite 10*a* the normal flow 10. This is particularly true when the path of the directional bore runs up hill and gravity forces the fluid in the drill string 54 to drain back to the drilling unit 52 when a drill pipe is disconnected. As shown in FIG. 3, when the drilling fluid attempts to flow in the direction opposite 10*a* of the normal flow direction, the ball 26 is forced against a back end 25 of pin 24 and blocks the internal passage 18. Preferably, there is a tapered seat 44 formed in the back of pin 24 to receive the ball 26.

The ball 26 may be formed in several ways. It may be solid and made from a plastic or polymer. Alternatively, it may be comprised of a hollow shell of plastic, metal, or composite. In the preferred embodiment, the density of the ball will be less than that of water, i.e., it will tend to float in the drilling fluid.

It will be appreciated that FIGS. 1-3 show a drill pipe assumed to be in "pin up" position—that is, the pin 24 is the closest part of each pipe segment 58 to the drilling machine 52. If, alternatively, the drill pipe is in a "pin down" position, the assembly of this disclosure could be altered to place the check ball toward the box end instead of the pin end.

Changes may be made in the construction, operation and arrangement of the various parts, elements, steps and procedures described herein without departing from the spirit and scope of the invention as described in the following claims.

The invention claimed is:

1. A drill pipe assembly, comprising:

a hollow pipe, the hollow pipe having a first internal passageway;

a pin end, adjoined to the hollow pipe, the pin end having a second internal passageway;

a liner tube disposed within the hollow pipe, the liner tube surrounding the first internal passageway; and a ball valve disposed between the first internal passageway and second internal passageway, the ball valve comprising:

a spacer having fluid passageways disposed therethrough, the spacer having an external diameter greater than an internal diameter of the first internal passageway; and a ball disposed between the second internal passageway and the spacer, wherein the ball is configured to obstruct flow directed from the first internal passageway to the second internal passageway; and wherein the spacer is configured to prevent the ball from obstructing flow directed from the second internal passageway to the first internal passageway.

2. The drill pipe assembly of claim 1 in which the spacer has a cross shape.

3. The drill pipe assembly of claim 2 in which the spacer comprises a plurality of rectilinear flanges disposed at the outer periphery of the cross shape, in which each of the rectilinear flanges are disposed at a greater effective diameter than the diameter of the first internal passageway.

4. The drill pipe assembly of claim 3 in which each of the rectilinear flanges is configured to abut an external shoulder of the liner tube.

5. The drill pipe assembly of claim 1 in which the spacer is aluminum.

6. The drill pipe assembly of claim 1 in which the ball has less density than water.

7. The drill pipe assembly of claim 1 in which the ball is hollow.

8. A drilling assembly comprising:

a horizontal directional drill;

a drill string having a first end and a second end, the drill string comprising a plurality of pipe sections connected at a plurality of pipe joints, wherein one of the plurality of pipe joints includes the drill pipe assembly of claim 1; wherein the drill string is attached to the horizontal directional drill at the first end; and a downhole tool attached at the second end of the drill string.

9. The drilling assembly of claim 8 in which the ball is disposed more closely to the first end of the drill string than the spacer in the one of the plurality of pipe joints which includes the drill pipe assembly.

10. A drilling assembly comprising:

a horizontal directional drill;

a drill string having a first end and a second end, the drill string comprising a plurality of pipe sections connected at a plurality of pipe joints, wherein each of the plurality of pipe joints includes the drill pipe assembly of claim 1; wherein the drill string is attached to the horizontal directional drill at the first end; and a downhole tool attached at the second end of the drill string.

11. A drill pipe assembly, comprising:

a hollow pipe, the hollow pipe having a first internal passageway;

a pin end, adjoined to the hollow pipe, the pin end having a second internal passageway;

a ball valve disposed between the first internal passageway and second internal passageway, the ball valve comprising:

a spacer having a cross shape and fluid passageways disposed therethrough, wherein the spacer comprises a plurality of rectilinear flanges disposed at the outer periphery of the cross shape, in which each of the rectilinear flanges are disposed at a greater effective diameter than the diameter of the first internal passageway; and a ball disposed between the second internal passageway and the spacer, wherein the ball is configured to obstruct flow directed from the first internal passageway to the second internal passageway; and wherein the spacer is configured to prevent the ball from obstructing flow directed from the second internal passageway to the first internal passageway.

12. The drill pipe assembly of claim 11 further comprising a liner tube disposed within the hollow pipe, in which each of the rectilinear flanges is configured to abut an external shoulder of the liner tube.

13. The drill pipe assembly of claim 11 in which the spacer is aluminum.

14. The drill pipe assembly of claim 11 in which the ball has less density than water.

* * * * *